US006057796A

United States Patent [19]

Kotsuka

[11] Patent Number: 6,057,796

[45] Date of Patent: May 2, 2000

[54] ELECTROMAGNETIC WAVE ABSORBER

[75] Inventor: Youji Kotsuka, Fujisawa, Japan

[73] Assignee: Kitagawa Industries Co., Ltd., Nagoya, Japan

[21] Appl. No.: 09/070,591

[22] Filed: Apr. 30, 1998

[30] Foreign Application Priority Data

May 1, 1997 [JP] Japan ..... 9-113987

[51] Int. Cl.[7] ..... H01Q 17/00

[52] U.S. Cl. ..... 342/1; 342/2; 342/3; 342/4

[58] Field of Search ..... 342/1, 2, 3, 4

[56] References Cited

U.S. PATENT DOCUMENTS

| | | | |
|---|---|---|---|
| 5,081,455 | 1/1992 | Inui et al. | 342/1 |
| 5,140,338 | 8/1992 | Schmier et al. | 343/909 |
| 5,180,513 | 1/1993 | Durand | 252/62.55 |
| 5,394,150 | 2/1995 | Naito et al | 243/4 |
| 5,453,755 | 9/1995 | Nakano et al. | 343/872 |
| 5,510,792 | 4/1996 | Ono et al. | 342/4 |
| 5,777,586 | 7/1998 | Luxon et al. | 343/702 |
| 5,833,770 | 11/1998 | Ominato et al. | 148/305 |

FOREIGN PATENT DOCUMENTS

| | | |
|---|---|---|
| 92/16031 | 9/1992 | WIPO . |
| 94/13029 | 6/1994 | WIPO . |

*Primary Examiner*—John B. Sotomayor
*Attorney, Agent, or Firm*—Davis and Bujold

[57] ABSTRACT

An electromagnetic wave absorber which is suitable for cellular phones, portable communication terminals and other portable electronic apparatus. The electromagnetic wave absorber is provided with a thin absorbing substrate formed of an electromagnetic wave absorbing material having a thickness of 0.01 $\mu$m to 1.0 mm. Such a thin absorbing substrate is realized by making adjustment holes in the absorbing substrate and increasing a value of apparent magnetic permeability. Specifically, even in the absorbing substrate as thin as 0.8 mm, by making multiple adjustment holes, electromagnetic waves can be absorbed in a frequency ranging from 1.5 to 2.2 GHz.

11 Claims, 8 Drawing Sheets

MATCHING FREQUENCY CHARACTERISTICS

MATCHING FREQUENCY CHARACTERISTICS

ELECTROMAGNETIC WAVE ABSORBER

BACKGROUND OF THE INVENTION

1. Field of the Invention

The present invention relates to an electromagnetic wave absorber.

2. Description of the Related Art

A conventional electromagnetic wave absorber is constituted of, for example, a ferrite or another magnetic material for suppressing the reflection of electromagnetic waves from a steel tower, a bridge, a multistoried building and the like to prevent adverse effects from being caused by the electromagnetic waves. Also, the electromagnetic wave absorber is used as a wall material in an electromagnetic wave dark room and for preventing electromagnetic waves from leaking from a microwave range and the like.

Recently, cellular phones, portable communication terminals and other portable electronic apparatus have been in general use. There has been a fear of problems caused by electromagnetic waves emitted from such apparatus. Especially, this is a problem when various electronic apparatus are made compact. Accordingly, a demand exists for a thin wave absorber for use as a lining material for such apparatus.

SUMMARY OF THE INVENTION

Wherefore, an object of the present invention is to provide an electromagnetic wave absorber which is suitable for portable electronic apparatus.

Another object of the invention is to provide an electromagnetic wave absorber whose matching frequency can be easily set.

Still another object of the invention is to provide an electromagnetic wave absorber which is suitable for a housing and the like in an electronic apparatus.

Further object of the invention is to provide an electromagnetic wave absorber which can be easily applied to a portable electronic apparatus.

Still further object of the invention is to provide an electromagnetic wave absorber which has a thin absorbing substrate To attain this and other objects the present invention provides an electromagnetic wave absorber which has an absorbing substrate constituted by forming an electromagnetic wave absorbing material into a 0.01 $\mu$m to 1 mm thick plate with at least one adjustment hole extending through the thickness of the absorbing substrate for adjusting a matching frequency of the absorbing substrate, the adjustment hole being a through hole.

Preferably the electromagnetic wave absorber of the invention is provided with a rear-face plate which is formed of a conductive plate material laminated to a rear face of the absorbing substrate and which may have a through hole made in a position connected to the adjustment hole.

A through hole formed in the rear-face plate may have a size different from a size of the adjustment hole of the absorbing substrate.

The adjustment hole may bc filled with a dielectric material, a resistive electromagnetic wave absorbing material other than the above electromagnetic wave absorbing material, or a magnetic material.

The absorbing plate may have a structure in which various types of absorbing substrate materials are distributed.

In the electromagnetic wave absorber of the invention, a plurality of conductive plates may extend from two opposite sides of the absorbing substrate in a direction normal to the front face of the substrate.

In the electromagnetic wave absorber of the invention, a conductive material may be formed in a lattice configuration on a surface of the absorbing substrate to extend normal to the front face of the substrate.

The absorbing substrate may be formed by applying, printing , or vapor depositing electromagnetic wave absorbing material onto the rear-face plate.

In the electromagnetic wave absorber of the invention, the absorbing substrate is made thin by making a through hole in the electromagnetic wave absorbing material. Further, it is made thinner by applying a magnetostatic field to the electromagnetic wave absorbing material and controlling its magnetic permeability.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

First the invention will be generally described with reference to FIGS. 1 to 3.

An electromagnetic wave absorber according to an embodiment of the invention is provided with a thin absorbing substrate having a thickness of 0.01 m to 1.0 mm formed of an electromagnetic wave absorbing material. The thickness of the electromagnetic wave absorber is generally determined by a material constant of the material constituting the electromagnetic wave absorbing substrate and an electromagnetic wave frequency to be absorbed. For example, it has been heretofore difficult to obtain an electromagnetic wave absorber as thin as 1.0 mm or less for the microwave band. Such a thin absorber can be realized by making an adjustment hole in the absorbing substrate. This respect will be described with reference to FIGS. 1A, 1B and 2.

Figure 1A:
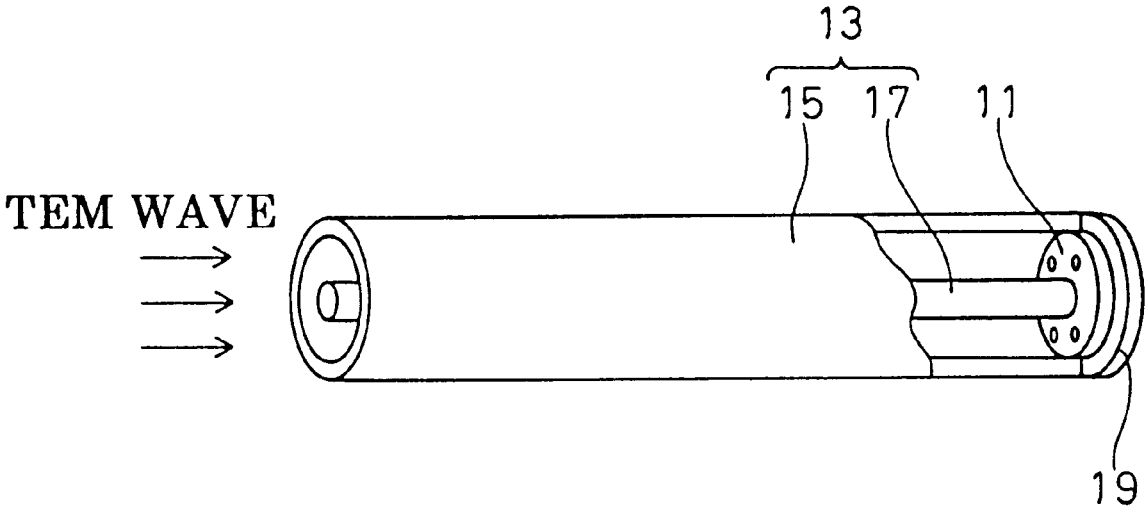
FIGS. 1A and 1B are explanatory views showing a test piece for use in an experiment which was conducted to prove effects of the present invention.
Figure 1B:
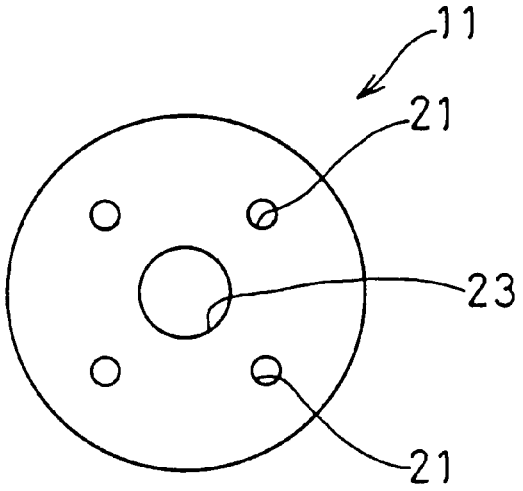
Figure 2:
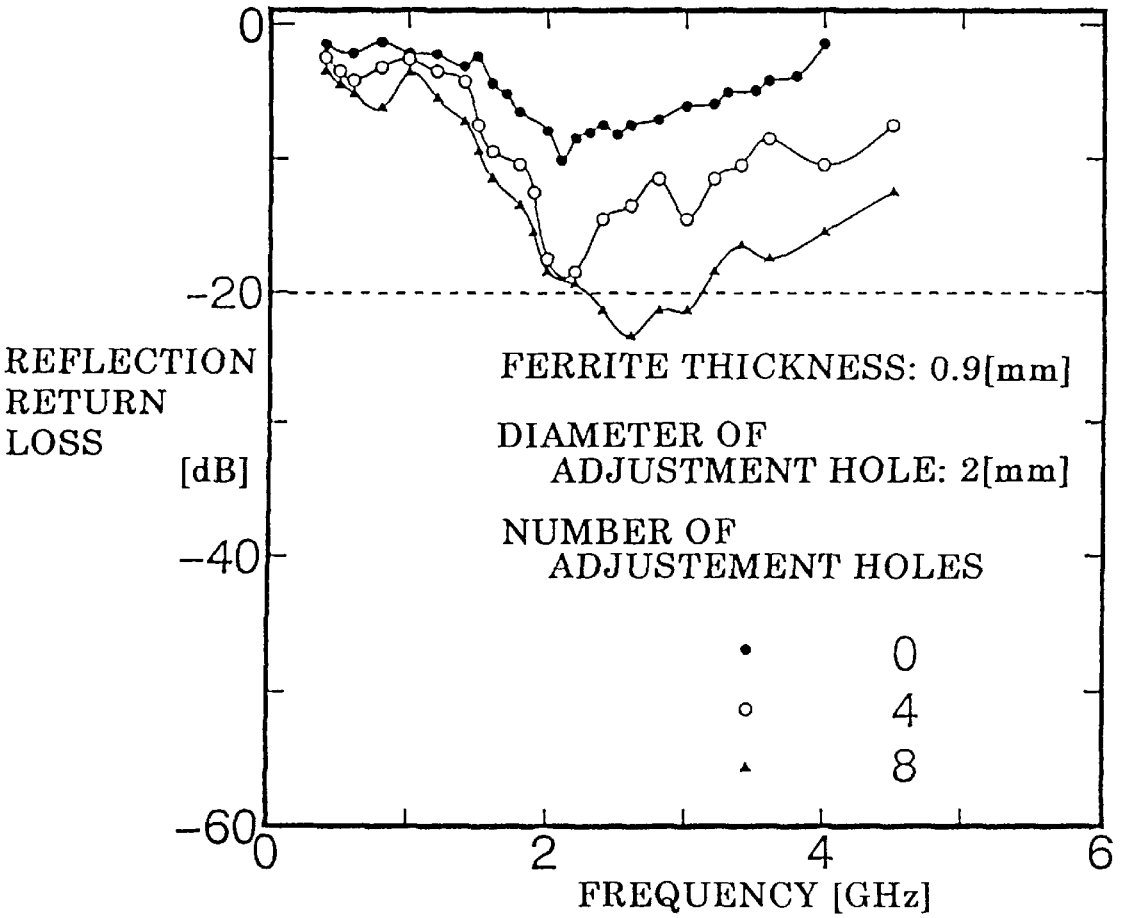
FIG. 2 is a graph showing results of the experiment which 10 was conducted by using the test piece shown in FIG. 1.

FIG. 1A is a perspective view of a test piece for use in an experiment, and FIG. 1B is a front view of the absorbing substrate. As shown in FIG. 1A, the test piece is provided with an absorbing substrate 11 which is formed in a disc configuration having a diameter of 19.44 mm and a thickness of 0.9 mm. The absorbing substrate 11 is mounted on a terninal end of a coaxial wave guide 13. Here, as the electromagnetic wave absorbing material forming the absorbing substrate 11 is a rubber ferrite. The coaxial wave gude 13 is constituted of an outer conductor 15 and an inner conductor 17. A rear face of the absorbing substrate 11 is provided with a conductive plate 19 for short-circuiting the outer and inner conductors 15 and 17. As shown in FIG. 1B, adjustment holes 21, each having a diameter of 2 mm, are provided at equal intervals on a circumference with a diameter of 11.0 mm in the absorbing substrate 11. For the experiment, a test piece with no adjustment hole 21 made therein, a test piece with four adjustment holes made therein and a test piece with eight adjustment holes made therein was prepared. Additionally, a central hole 23 in the absorbing substrate 11 is made for passing the inner conductor 17.

Figure 8:
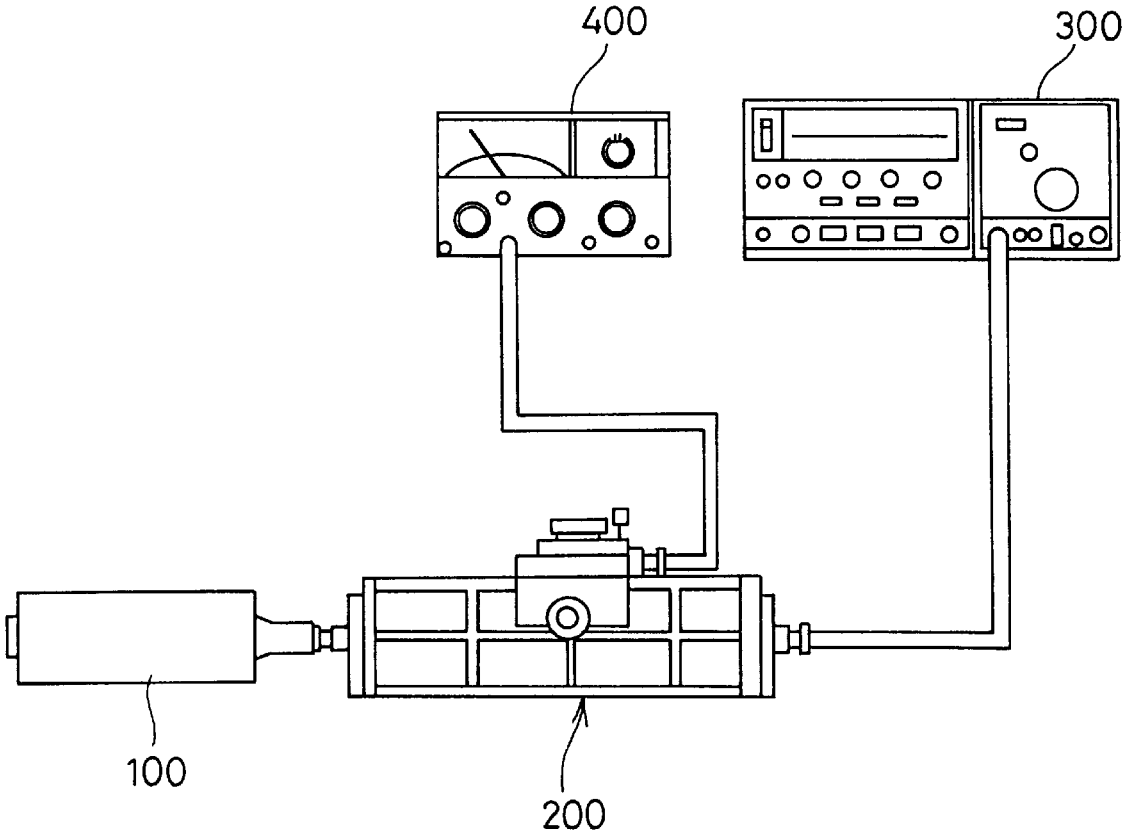
FIG. 8 is a schematic drawing showing the instrument for measuring an electromagnetic wave reflection return loss used in the embodiments of the invention.

In the experiment, the three types of the absorbing substrates 11 were attached to the coaxial wave guides 13, one at a time. A TEM (traverse electromagnetic) wave was radiated to the test piece from the left side as seen in FIG. 1A. On the same side, an intensity of the wave was measured, and an electromagnetic wave reflection return loss was calculated from the intensity. The electromagnetic wave reflection return loss was measured by an ordinary standing-wave measuring method using a measuring instrument shown in FIG. 8. This instrument comprises a standing-wave measuring detector 200 connected to a coaxial wave guide 100, having the absorbing substrates to be tested, an oscillator 300, and a standing-wave detector 400. Results are shown in FIG. 2. In the graph of FIG. 2, frequencies are represented on the abscissa axis and the electromagnetic wave reflection return losses calculated for the respective frequencies are represented on the ordinate axis As shown in FIG. 2, when eight adjustment holes 21 are formed, the electromagnetic wave reflection return loss is −20 dB at the frequency of 2.2 to 3 GHz. Specifically, when multiple micro adjustment holes are made in the absorbing substrate 11 as thin as 0.9 mm, its matching characteristics can be improved as compared with the absorbing substrate with no adjustment hole made therein. In this case, the wave can be absorbed at a frequency ranging from 2.2 to 3GHz.

Figure 3:
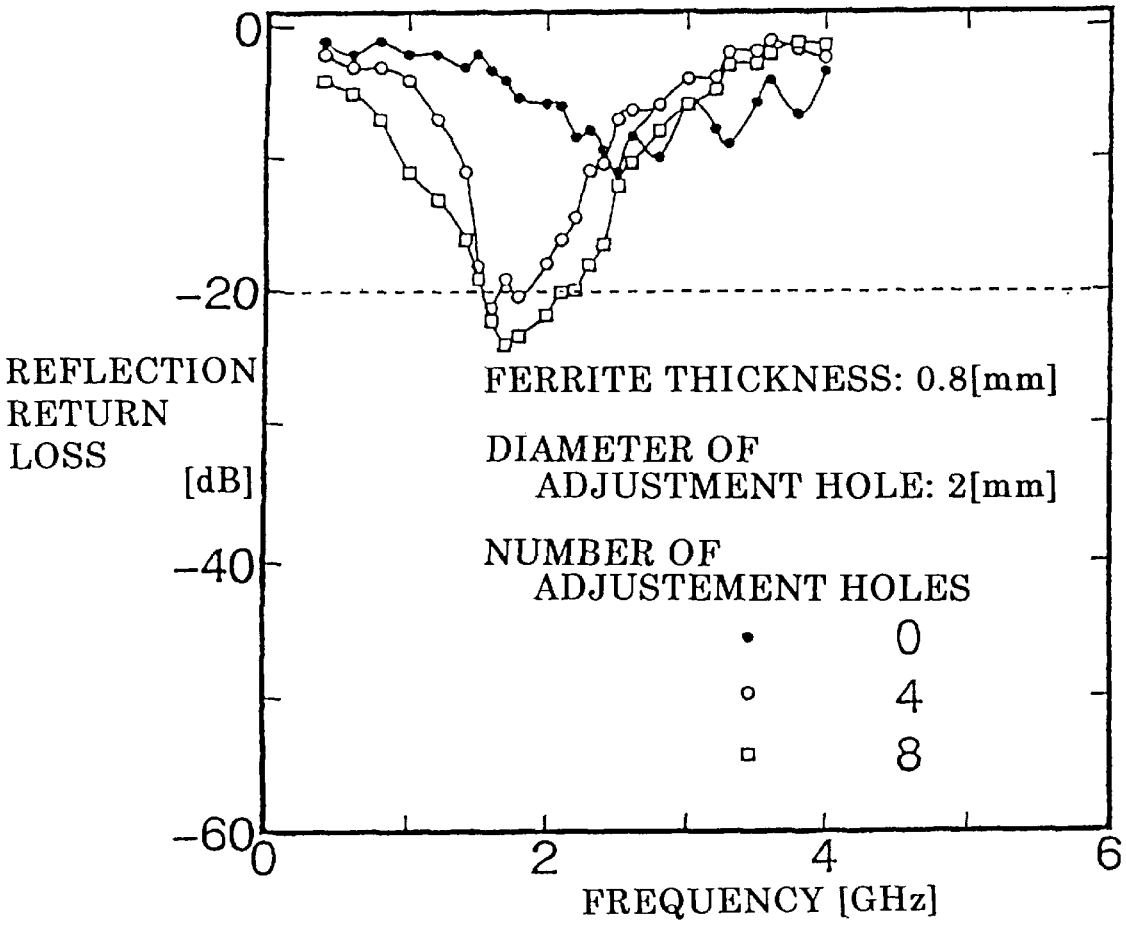
FIG. 3 is a graph showing results of a further experiment which uses a different thickness of absorbing substrate.

FIG. 3 shows a graph in which the thickness of the absorbing substrate 11 is changed to 0.8 mm. When the absorbing substrate 11 with eight adjustment holes made therein is 0.8 mm thick, the matching frequency is 1.5 to 2.2 GHz. With an absorbing substrate of 1 mm or thinner, by properly making the adjustment holes therein, an absorbing substrate formed of rubber ferrite can absorb electromagnetic waves at a frequency of 1 GHz or more.

As a result of the experiment conducted by the inventor, it is apparent that when through holes are made in a 1 mm or thinner absorbing substrate, a frequency, at which an imaginary part of a specific magnetic permeability value $\mu_r=\mu_r'-j\mu_r''$ is increased and a real part is 1, is lowered against expectation. Based on this fact, the present invention has been developed. Specifically, even when the through holes are made, the following relationship indicative of the conditions of the electromagnetic wave absorbing material for absorbing electromagnetic waves is maintained.

$$\mu_r''>\mu_r' \quad (1)$$

In the relationship, $\mu_r'$ is substantially 1. In this case, when the absorbing substrate is 2 to 8 mm thick, by making through holes, either $\mu_r'$ or $\mu_r''$ is increased. Especially, the frequency at which the magnetic permeability real part $\mu_r'$ related with the matching frequency substantially becomes 1 is shifted to a higher-frequency range, However, when the thickness is 1 mm or less, by making the through holes, the increased real part $\mu_r'$ and the imaginary part $\mu_r''$ of the magnetic permeability start decreasing their values. The frequency at which $\mu_r'$ becomes 1 is again shifted toward a lower-frequency range. In this case, however, the value of $\mu_r''$ still maintains the relationship shown in the above (1). Specifically, the value is equal to or slightly larger than the value of $\mu_r''$ at the time of original matching (where no through hole is made). As a result, the characteristics equal to matching characteristics in the original matching thickness (e.g. 8 mm) can be provided by making the through holes in a thin absorbing substrate having a thickness of 1 mm or less. The through holes correspond to the adjustment holes of the invention.

The principle of the invention can be explained from the viewpoint of transmission-line theory (strictly speaking, spatial network theory) concerning the transmission-line equivalent to this electromagnetic wave absorber as well as of the characteristics of the material in terms of the magnetic permeability. In other words, by providing micro holes, changes in the load impedance at the terminal of this transmission-line which corresponds to the electromagnetic wave absorber, are made, and absorption of electromagnetic wave is realized by resonance caused by the above changes. Specifically, providing holes causes changes in mainly capacity component of the load impedance at the terminal of the transmission-line and consequently resonance to a certain frequency. The resonance frequency generally depends on the size of the hole. There is a tendency that when the frequency is higher, smaller holes can cause resonance.

Accordingly, by using not only a magnetic material like ferrite but also another material such as dielectric electromagnetic wave absorber, resistance film or the like as an electromagnetic wave absorbing material, it is possible to make changes in the capacity of the load impedance by providing holes and constitute an electromagnetic wave absorber according to the above mentioned principle. For example, when iron carbonyl substrate is used with holes, having a diameter of 1 mm, formed at regular intervals of 2 mm, the iron carbonyl substrate can be made as thin as up to 0.6 mm in order to acquire matching to the electromagnetic wave at the frequency of 20 GHz. When a resistance film is used with holes, having a diameter of 0.5 mm, formed at regular intervals of 1.5 mm, the resistance film can be made as thin as up to 0.01 $\mu$m in order to acquire matching to the electromagnetic wave at the frequency of 60 GHz.

As aforementioned, the electromagnetic wave absorber of the embodiment is as thin as 1 mm or less. By placing the electromagnetic wave absorber on the inner face of a housing of an electronic apparatus or the like, electromagnetic waves leaking from the apparatus can be absorbed. Also, since the electromagnetic wave absorber is thin, it is light-weighted. By this means, the electromagnetic wave problems caused by cellular phones, portable communication terminals and other portable electronic apparatus can be prevented or substantially reduced. Also, by placing the electromagnetic wave absorber on a wall paper or the like, an electromagnetic wave dark room can be produced.

The electromagnetic wave absorber according to an embodiment of the invention includes a conductive rear-face plate laminated to a rear face of the absorbing substrate, and through holes are formed in the plate in positions which are connected to the adjustment holes. The rear-face plate corresponds to the short-circuit plate shown in FIG. 1A. The through holes are made in the rear-face plate, and matched with the adjustment holes which are made in the substrate. In this case, the through holes have the same action as the adjustment holes, and can adjust the matching characteristics. The action is influenced by the size of the through hole.

Therefore, the size can be varied between the adjustment hole and the through hole in the rear-face plate.

Also, the adjustment hole may be filled with a dielectric material, a resistive electromagnetic wave absorbing material other than the above electromagnetic wave absorbing material, or a magnetic material. As the dielectric material, including ferroelectric material such as barium titanate, polyethylene, carbon graphite and the like are available. In this case, the matching characteristics can be shifted toward a lower-frequency range.

Alternatively, plural types of absorbing substrate materials may be provided, and through holes may be made in these materials. In the constitution, based on the matching characteristics of the respective electromagnetic wave absorbing materials, the matching characteristics of the absorbing substrate can be set.

In order to distribute the absorbing substrate materials, for example, square plates of the same size are formed of two types of electromagnetic wave absorbing materials. These plates are arranged in a checkered pattern. Alternatively, one type of the electromagnetic wave absorbing material is arranged in a pattern of a lattice, while the other type of electromagnetic wave absorbing material is arranged or embedded in the lattice. The electromagnetic wave absorbing materials may be arranged in a stripe pattern. Of course, by distributing three or more types of electromagnetic wave absorbing materials, the absorbing substrate can be formed.

Also, when the electromagnetic wave absorber of the invention is attached inside a resin housing, a plurality of conductive plates are vertically built on two opposite sides of the absorbing substrate. In this case, the plate material has the same function as the cylindrical portion or outer conductor 15 shown in FIG. 1A, forms a TEM wave and effectively absorbs electromagnetic waves. Therefore, the electromagnetic wave absorber provides the same effect as shown in FIGS. 2 and 3. The electromagnetic wave absorber is suitable for preventing electromagnetic waves from leaking from a portable personal computer of which the housing is formed of resin or the like.

Alternatively, a conductive material may be formed in a lattice pattern on the surface of the absorbing substrate. Also, in this case, the latticed conductive material performs the same function as the outer conductor 15 and provides the same effect as shown in FIGS. 2 and 3. Additionally, as the latticed conductive material, carbon graphite, metal powder and the like are available.

A thin absorbing substrate can be formed by depositing an electromagnetic wave absorbing material onto the rear-face plate. A paste of electromagnetic wave absorbing material may be applied or printed, as a way of deposition, onto the rear-face plate in order to form an absorbing substrate as thin as 0.1 mm. To apply the paste, spraying, brushing or another method may be used. For printing, a silk screening or another method is available. For the adjustment holes, a seal or another mask is placed on the rear-face plate before applying the paste, or the paste is applied beforehand to the rear-face plate with the through holes made therein. Also, in order to print the paste, for example, a holed pattern is printed on the rear-face plate. In this manner, the thin absorbing substrate can be formed.

Also, an electromagnetic wave absorbing material may be vapor deposited, as a way of deposition, onto the rear-face plate in order to form an extremely thin absorbing substrate having a thickness of 0.01 $\mu$m. When the above mentioned resistance film is used as an electromagnetic wave absorbing material, it is recommended that an absorbing substrate be formed in this way.

Further, the through holes are made in the electromagnetic wave absorbing substrate to allow a thinner substrate. In addition, by applying a magnetostatic field to the substrate, its magnetic permeability is changed so that the electromagnetic wave absorbing substrate can be made thin. This is based on a principle that when the magnetostatic field is applied in a direction orthogonal to a microwave field, the imaginary part of complex permeability is increased.

Preferred embodiments of the invention will be described with reference to FIGS. 4A to 7B.

Figure 4A:
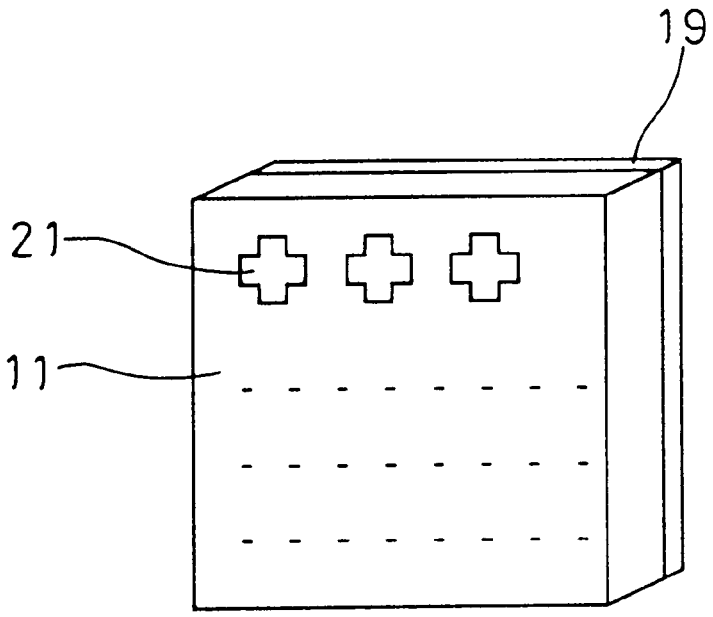
FIGS. 4A and 4B are perspective views showing first and second embodiments of the invention.

According to a first embodiment of the invention, in an electromagnetic wave absorber shown in FIG. 4A, cruciform adjustment holes 21 are made in an 0.8 mm thick absorbing substrate 11. The electromagnetic wave absorber with the adjustment holes 21 formed therein can fulfill certain matching characteristics.

Figure 4B:
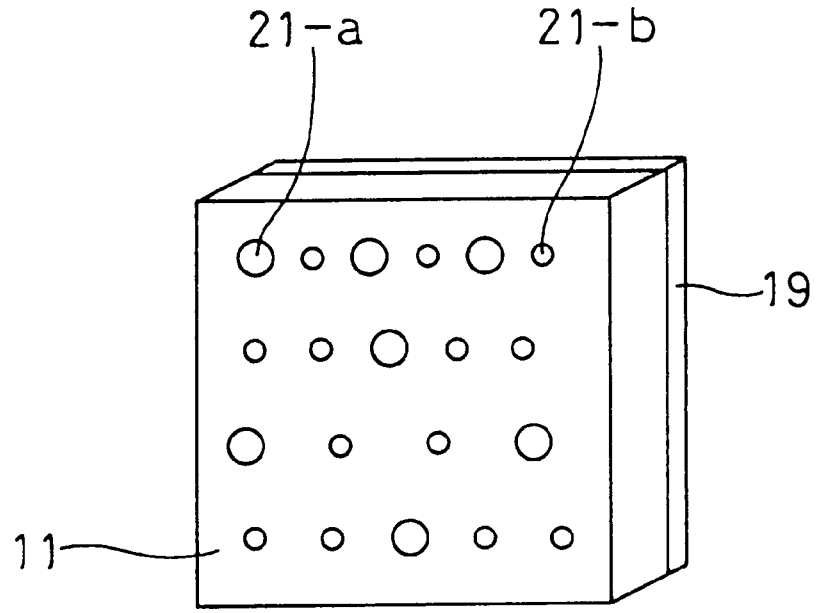

According to a second embodiment, in an electromagnetic wave absorber, shown in FIG. 4B, circular relatively large adjustment holes 21-*a* and relatively small adjustment holes 21-*b* are formed in a surface of the absorbing substrate 11. In this second embodiment, elements are constituted by overlapping the adjustment holes 21-*a* and 21-*b*. By changing the ratio of the adjustment holes 21-*a* relative to the adjustment holes 21-*b*, the arrangement of the holes, hole diameters and the like, the matching characteristics can be adjusted.

Figure 5A:
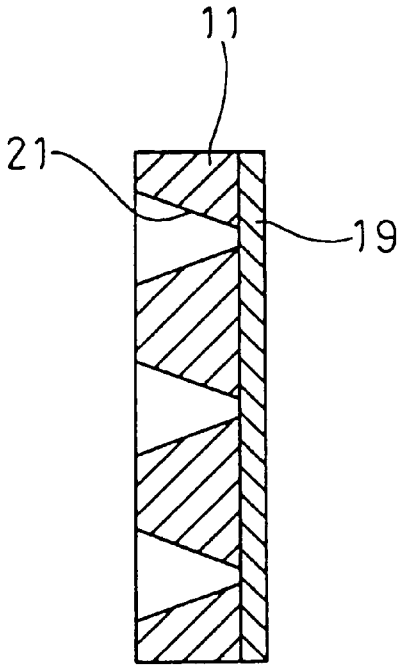
FIGS. 5A and 5B are perspective views showing third and fourth embodiments of the invention.
Figure 5B:
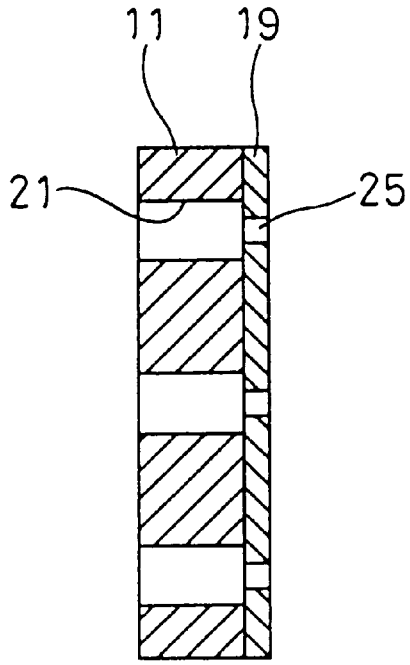

FIGS. 5A and 5B are sectional view showing electromagnetic wave absorbers according to third and fourth embodiments, respectively. In an electromagnetic wave absorber of the third embodiment shown in FIG. 5A, the diametcr of the adjustment hole 21 is changed in a direction of the thickness of the absorbing substrate 11. As a result, the adjustment hole 21 is conical. In the third embodiment, the matching characteristics are exhibited by a mixture of the diameters in a vicinity of the conductive plate 19, diameters at the exposed surface of the absorbing substrate 11 and the intermediate diameters. Also, by changing a conical taper, the matching characteristics can be changed.

In the electromagnetic wave absorber of the fourth embodiment, as shown in FIG. 51B, by making through holes 25 in the conductive plate 19, the matching characteristics are adjusted. Also, by changing the configurations of the through holes 25, the matching characteristics can be controlled. Although each of most adjustment holes 21 is in communication with the through holes 25, there may be some adjustment holes 21 that are not in communication with the through holes 25.

Figure 6A:
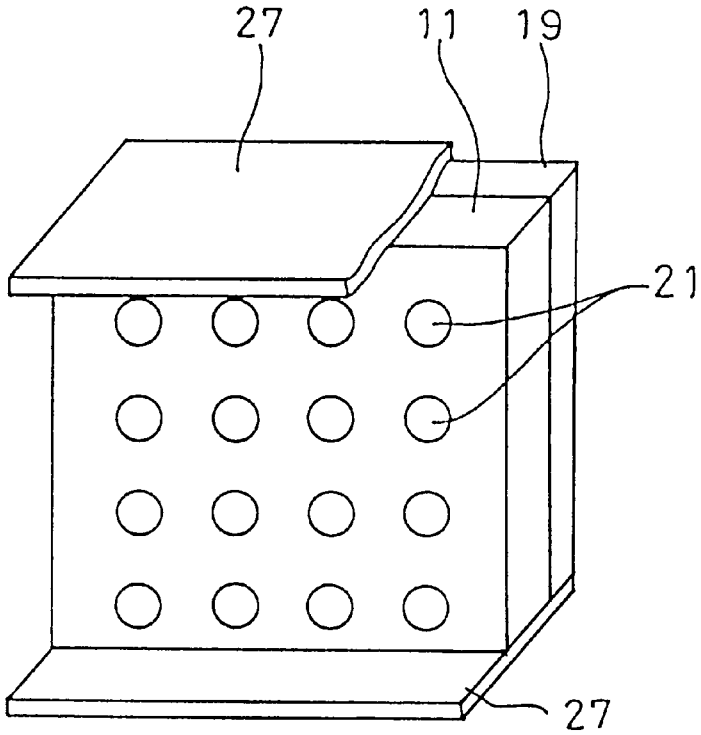
FIGS. 6A and 6B are perspective views showing fifth and sixth embodiments of the invention.

According to a fifth embodiment, in an electromagnetic wave absorber of FIG. 6A, a plurality of conductive plates 27 are vertically built on two opposite sides of the absorbing substrate 11. In the fifth embodiment, the plate material 27 performs the same function as the inner and outer conductors 15 and 17, and fulfills the effects in the same manner as shown in FIGS. 2 and 3. It is preferable that such an electromagnetic wave absorber should be put inside the resin housing of an electronic apparatus.

Figure 6B:
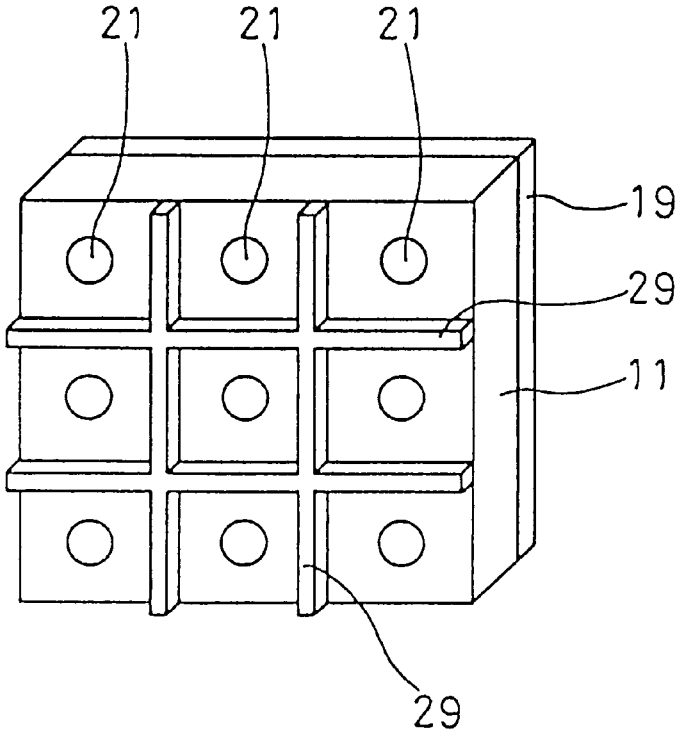

FIG. 6B shows alternatives to the inner and outer conductors 15 and 17. According to a sixth embodiment, in an electromagnetic wave absorber of FIG. 6B, a conductive material 29 is formed in a lattice configuration on the surface of the absorbing substrate 11. Also in the sixth embodiment, the latticed conductive material 29 performs the same function as the cylindrical portion or inner conductor 15, and fulfills the effects in the same manner as shown in FIGS. 2 and 3.

Figure 7A:
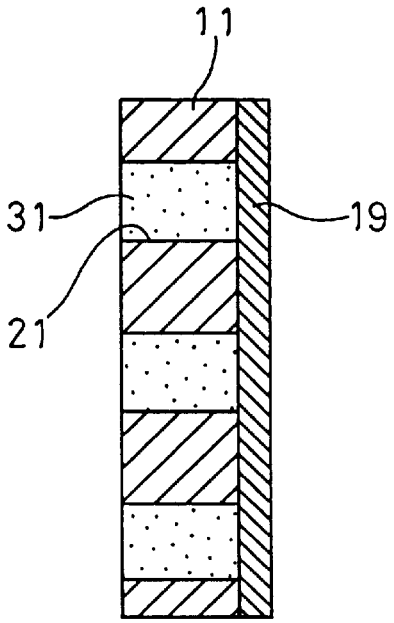
FIGS. 7A and 7B are perspective views showing seventh and eighth embodiments of the invention.

According to a seventh embodiment, in an electromagnetic wave absorber of FIG. 7A, the adjustment holes 21 are filled with dielectric materials 31. In the seventh embodiment, the matching characteristics of the electromagnetic wave absorber can be shifted to a lower-frequency. The shift quantity can be adjusted by the type of the dielectric material 31 and the configuration and arrangement of the adjustment hole 21. Additionally, there may be some adjustment holes 21 which are not filled with the dielectric materials 31.

Figure 7B:
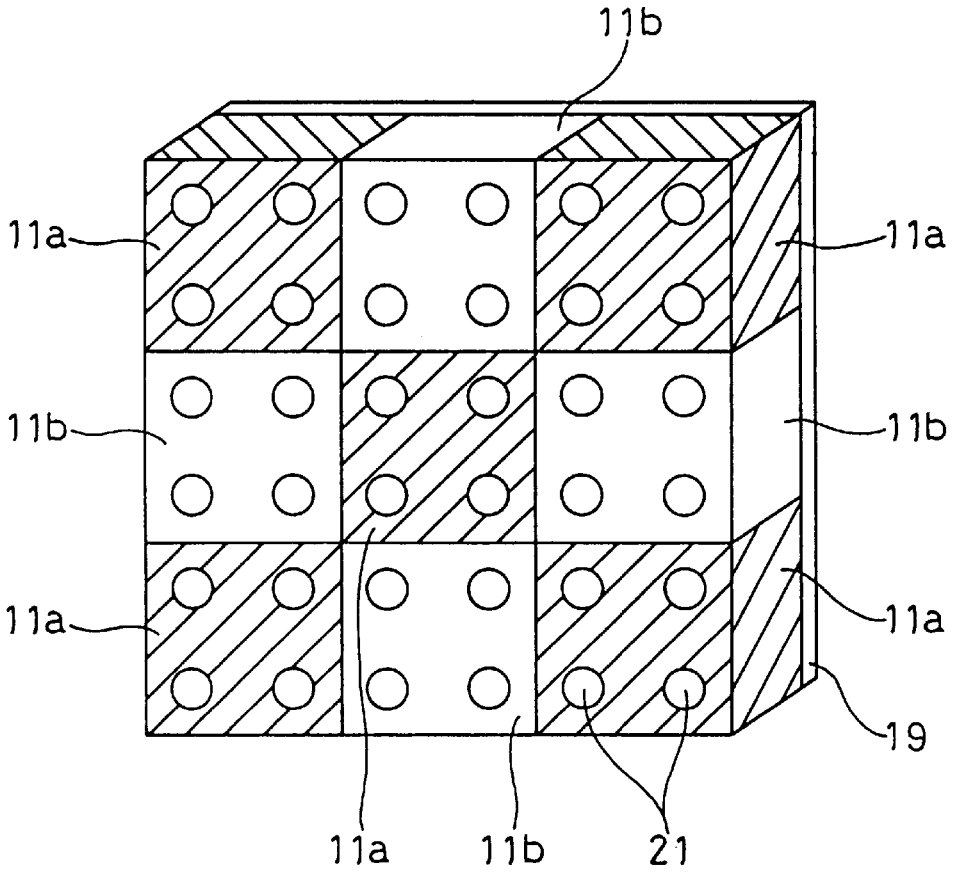

According to an eighth embodiment, in an electromagnetic wave absorber of FIG. 7B, the absorbing substrate 11 is constituted as a complex absorbing substrate by distributing absorbing substrates 11*a* and 11*b* which are formed of electromagnetic wave absorbing materials different with each other in matching frequency, for example, Ni-Zn system and Mg-Zn system materials. In the eighth embodiment, the intermediate matching frequency between the matching frequencies of the electromagnetic wave absorbing materials can be obtained. Further, by providing the adjustment holes 21, the absorbing substrates 11*a* and 11*b* can be made thinner. Additionally, the matching frequency characteristics can be changed broadly by varying the holes 21 and the distribution of the different materials.

While the preferred embodiments of the invention have been described, it is to be understood that the invention is not limited thereto, and may be otherwise embodied within the scope of the appended claims.

For example, the electromagnetic wave absorbing material may have a dielectric carbon graphite constitution or may be tapered in such a manner that its material constant is gradually changed from an electromagnetic wave incident side. In the modification, the broader-band characteristics can be advantageously obtained. Alternatively, plural electromagnetic wave absorbing materials may be laminated.

What is claimed is:

1. An electromagnetic wave absorber which comprises:

an absorbing substrate constituted by forming an electromagnetic wave absorbing material into a 0.01 $\mu$m to 1 mm thick plate;

at least one adjustment hole, extending through the thickness of said absorbing substrate, for adjusting a matching frequency of said absorbing substrate, said adjustment hole being a through hole and a rear-face plate which is formed of a conductive material laminated to a rear face of said absorbing substrate.

2. An electromagnetic wave absorber according to claim 1 wherein at least one through hole is provided in the conductive material in alignment with at least one adjustment hole.

3. An electromagnetic wave absorber according to claim 2 wherein at least one through hole formed in said rear-face plate has a size different from a size of the associated adjustment hole of the absorbing substrate.

4. An electromagnetic wave absorber according to claim 1 wherein said at least one adjustment hole is filled with one of a dielectric material, a resistive electromagnetic wave absorbing material other than the electromagnetic wave absorbing material, and a magnetic material.

5. An electromagnetic wave absorber according to claim 1 wherein said absorbing plate has a structure comprising a plurality of different wave absorbing materials.

6. An electromagnetic wave absorber according to claim 1 wherein a plurality of conductive plates extends from two opposite sides of said absorbing substrate normal to a front face thereof.

7. An electromagnetic wave absorber according to claim 1 wherein a conductive material is formed in a lattice configuration on a surface of said absorbing substrate.

8. An electromagnetic wave absorber according to claim 1, wherein said absorbing substrate is a material composed substantially of rubber ferrite.

9. A method of manufacturing an electromagnetic wave absorber which comprises:

a) forming an electromagnetic wave absorbing material into a 0.01 $\mu$m to 1 mm thick absorbing substrate; and b) forming at least one adjustment through hole, extending through the thickness of said absorbing substrate, to adjust a matching frequency of said absorbing substrate.

10. The method of claim 9 comprising: controlling magnetic permeability of the electromagnetic wave absorbing material by the application thereto of a magnetostatic field.

11. The method of claim 9 including the step of laminating the absorbing substrate a rear face plate of a conductive material.

* * * * *